US006470522B2

(12) United States Patent
Veltz et al.

(10) Patent No.: US 6,470,522 B2
(45) Date of Patent: Oct. 29, 2002

(54) COMBINATION TOOL WITH ASYMMETRIC FOLDING STRUCTURE

(75) Inventors: Jason D. Veltz, LaJolla, CA (US); Thomas A. Gaboury, El Cajon, CA (US); Stephen J. Hull, San Diego, CA (US)

(73) Assignee: Buck Knives, Inc., El Cajon, CA (US)

( * ) Notice: Subject to any disclaimer, the term of this patent is extended or adjusted under 35 U.S.C. 154(b) by 0 days.

(21) Appl. No.: 09/758,586

(22) Filed: Jan. 10, 2001

(65) Prior Publication Data

US 2002/0088060 A1 Jul. 11, 2002

(51) Int. Cl.[7] ..... B25B 7/22
(52) U.S. Cl. ..... 7/128; 30/153; 81/427.5
(58) Field of Search ..... 7/125, 126, 127, 7/128; 30/153, 161; 81/427.5, DIG. 1

(56) References Cited

U.S. PATENT DOCUMENTS 1,409,971 A * 3/1922 Riedesel ..... 81/DIG. 1 X
4,271,592 A * 6/1981 Hoptner ..... 30/153
5,960,498 A * 10/1999 Nabors et al. ..... 7/128
5,979,959 A * 11/1999 Rivera ..... 7/128 X

* cited by examiner

*Primary Examiner*—James G. Smith
(74) *Attorney, Agent, or Firm*—Gregg Garmogg

(57) ABSTRACT

A folding combination tool includes a jaw mechanism with a first jaw piece having a first lug attachment, a second jaw piece having a second lug attachment, and a jaw pivot that joins the first jaw piece and the second jaw piece so that the first jaw piece and the second jaw piece may pivot with respect to each other in a pivot plane. A first handle is pivotably attached to the first lug attachment by a first handle pivot lying perpendicular to the pivot plane, so that the first handle is pivotable about the jaw mechanism in the pivot plane. A second handle is pivotably attached to the second lug attachment by a second handle pivot lying perpendicular to the pivot plane, so that the second handle is pivotable about the jaw mechanism in the pivot plane. A first lug attachment spacing of the first lug attachment from the jaw pivot is greater than a second lug attachment spacing of the second lug attachment from the jaw pivot, so that the handles asymmetrically fold around the jaw mechanism.

23 Claims, 2 Drawing Sheets

COMBINATION TOOL WITH ASYMMETRIC FOLDING STRUCTURE

This invention relates to a combination tool and, more particularly, to a combination tool with an asymmetric folding structure.

BACKGROUND OF THE INVENTION

In a typical modem combination tool, two handles are pivotably attached to a jaw mechanism in the form of a pliers or a scissors. The two handles may be folded to closed positions adjacent to the jaw mechanism or to unfolded positions where the handles may be grasped to operate the jaw mechanism. Implements such as knives, screwdrivers, files, and the like are pivotably attached to the distal ends of the handles remote from the jaw mechanism. The implements may be pivoted to closed positions lying within or adjacent to the respective handles or to open positions wherein the implements may be used. The combination tool thus is functional for a wide variety of common applications.

The user is usually provided with a pouch for storing and carrying the combination tool when it is not being used. The pouch has a belt loop so that the pouch and the combination tool may be carried on the belt of the user.

Although combination tools have become popular for both professional and recreational users and are quite useful in many circumstances, the inventors have recognized that the existing combination tools have drawbacks in some circumstances. As to the combination tools themselves, the combination tool is ordinarily stored in its pouch in the folded configuration. The implements that are stored within the interior of the handle cannot be opened from their closed positions within the handles when the handles are folded. The handles must therefore be at least partially unfolded to access the implements. Once the implements are opened, the handles are shaped such that the use of certain of the implements, such as a knife blade, may be awkward and uncomfortable.

As to the storage pouch, carrying the pouch on a belt loop is not practical in some circumstances. For example, a worker who wears protective winter outer clothing may have difficulty reaching the combination tool in the pouch under the outer clothing. A backpacker who has the backpack suspended from a padded hip belt may not be able to attach the pouch to a belt. Many people do not care to use belts in some circumstances. The carrying of the combination tool may therefore be difficult or uncomfortable at times.

There is a need for an improved approach to both the functionality of the combination tool and its storage when not in use. The present invention fulfills these needs, and further provides related advantages.

SUMMARY OF THE INVENTION

The present invention provides a combination tool that incorporates both a jaw mechanism and implements that pivot between open and closed positions. The jaw mechanism and implements are fully functional. The combination tool allows the jaw mechanism to be operated in the usual manner when the handles are unfolded. When the handles are folded, the jaw mechanism fits asymmetrically within the handles in a manner that leaves a maximum amount of usable space for the implements and other structure. When the handles are folded, the combination tool is employed more in the manner of a knife, with a comfortably shaped handle and interiorly stored implements that open easily. Implement-locking techniques such as side locks may be used. The combination tool may be provided with an attachment structure that permits it to be conveniently carried in many circumstances without a storage pouch, or the combination tool may be carried in a pouch.

In accordance with the invention, a folding combination tool comprises a jaw mechanism including a first jaw piece having a first lug attachment, a second jaw piece having a second lug attachment, and a jaw pivot that joins the first jaw piece and the second jaw piece so that the first jaw piece and the second jaw piece may pivot with respect to each other in a pivot plane. The jaw mechanism is typically a pliers or a scissors. A first lug attachment spacing of the first lug attachment from the jaw pivot is greater than a second lug attachment spacing of the second lug attachment from the jaw pivot, producing an asymmetric structure. A first handle is pivotably attached to the first lug attachment by a first handle pivot lying perpendicular to the pivot plane, so that the first handle is pivotable about the jaw mechanism in the pivot plane, and a second handle is pivotably attached to the second lug attachment by a second handle pivot lying perpendicular to the pivot plane, so that the second handle is pivotable about the jaw mechanism in the pivot plane.

In one embodiment, the first handle comprises an attachment clip having a gate facing away from the jaw mechanism when the first handle is in the folded position. The attachment clip may be clipped to bulky articles, such as D-rings or metal loops, so that the combination tools may be temporarily attached to such bulky articles and conveniently carried in this manner. The asymmetric folding of the handles about the jaw mechanism provides sufficient space in the folded combination tool that the attachment clip is outwardly facing and exposed for use.

The second handle comprises a first side, a second side parallel to but spaced apart from the first side, a second-handle pivot pin extending between the first side and the second side at a location remote from the first lug attachment, and at least one implement pivotably supported on the second-handle pivot pin. A lock such as a side lock may be provided to releasably lock the implement into the open position.

Stated alternatively, a folding combination tool comprises a jaw mechanism including a first jaw piece having a first lug attachment, a second jaw piece having a second lug attachment, and a jaw pivot that joins the first jaw piece and the second jaw piece so that the first jaw piece and the second jaw piece may pivot with respect to each other in a pivot plane. A first handle is pivotably attached to the first lug attachment by a first handle pivot lying perpendicular to the pivot plane, so that the first handle is pivotable about the jaw mechanism in the pivot plane between a fully folded position wherein the first handle lies adjacent to the jaw mechanism and an unfolded position. A second handle is pivotably attached to the second lug attachment by a second handle pivot lying perpendicular to the pivot plane, so that the second handle is pivotable about the jaw mechanism in the pivot plane between a fully folded position wherein the second handle lies adjacent to the first handle and an unfolded position. The second handle comprises a first side and a second side parallel to but spaced apart from the first side. The second handle is desirably contoured in the manner of a conventional folding knife to have a comfortable feel in the hand of the user when the combination tool is folded closed, and the pivoting implements are opened. The jaw mechanism is asymmetrically positioned with respect to the first handle and the second handle when the first handle and the second handle are in their fully folded positions. The jaw mechanism lies at least in part between the first side and the second side of the second handle when the first handle and the second handle are in their fully folded positions.

Desirably, the second handle further comprises a second-handle pivot pin extending between the first side and the second side at a location remote from the first lug attachment, and at least one implement pivotably supported on the second-handle pivot pin. Each implement is pivotable in the pivot plane between a closed position wherein the implement lies between the first side and the second side and an open position wherein the implement is extended from the second handle.

The asymmetric attachment of the handles to the jaw mechanism positions the jaw mechanism primarily into the second handle when the handles are folded. The jaw mechanism is substantially clear of the folded first handle. The first handle therefore may accommodate features to which access is necessary when the handles are folded. In the preferred case, the attachment clip of the first handle is accessible when the handles are folded, as it must be to be used for attachment of the folded combination tool to bulky objects. The asymmetric positioning of the folded jaw mechanism also results in a maximum of usable space within the folded structure to accommodate the folded implements.

An important feature of these combination tools is that each implement of the second handle is pivotable between its closed position between the sides of the second handle and its open position when the first handle and the second handle are in their folded positions. That is, each implement pivots away from the first handle when the first handle and the second handle are in their folded positions.

The present invention provides a combination tool that provides a fully functional jaw mechanism when the handles are unfolded. When the handles are folded, the implements in the second handle may be opened (and optionally releasably locked open) without unfolding the handles. The handles are contoured so as to permit the combination tool to function in the manner of a knife when the handles are folded. The attachment clip on the first handle allows the folded combination tool to be conveniently attached to bulky objects, or to be stored in a pouch.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
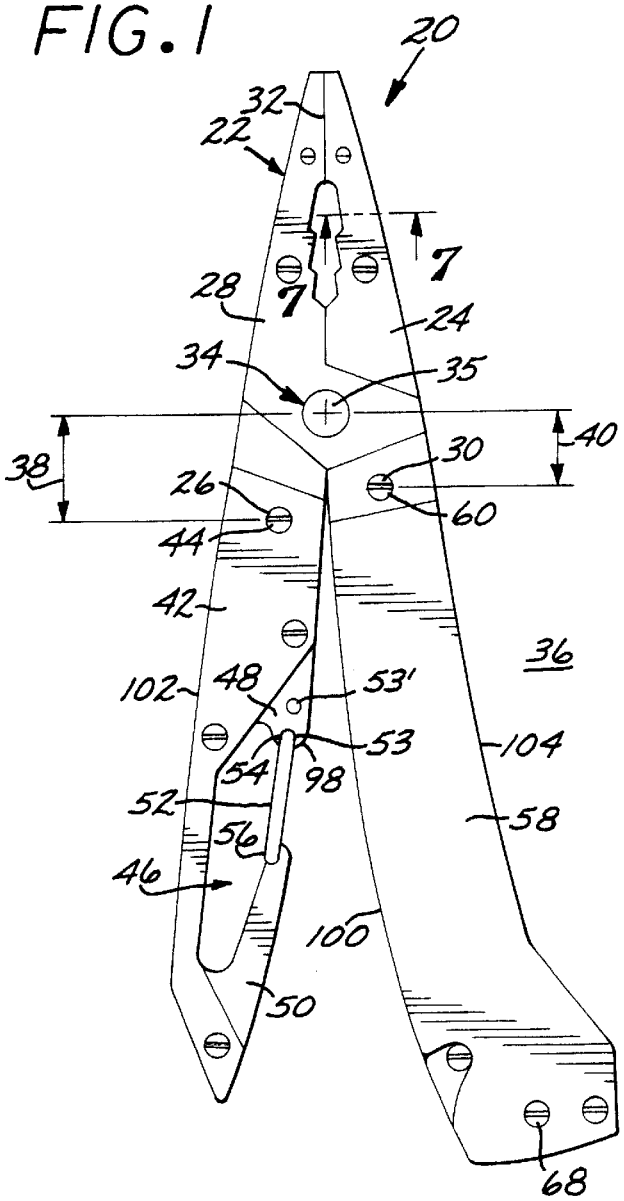
FIG. 1 is a plan view of a combination tool with the handles unfolded.
Figure 2:
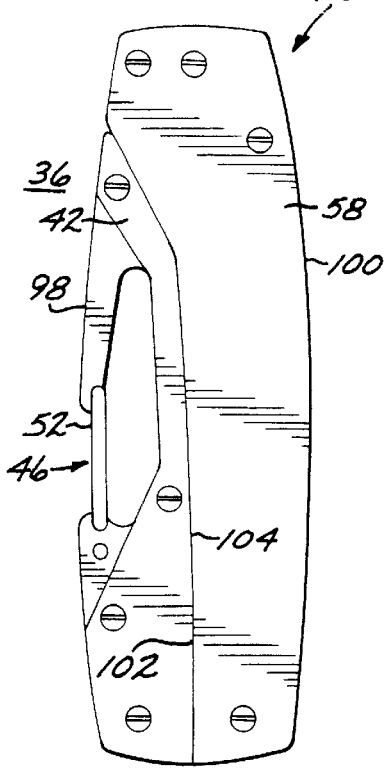
FIG. 2 is a plan view of the combination tool of FIG. 1, with the handles folded.

FIG. 1 illustrates a combination tool 20 with the handles in the unfolded positions, and FIG. 2 illustrates the combination tool 20 with the handles in the folded position. The folding combination tool 20 comprises a jaw mechanism 22 including a first jaw piece 24 having a first lug attachment 26, and a second jaw piece 28 having a second lug attachment 30. The lug attachments 26 and 30 each preferably comprise bores through their respective jaw pieces 24 and 28, the bores extending perpendicular to the plane of the page in FIG. 1. (Equivalently, the lug attachments may be pins that are received in bores in the handles.) The illustrated jaw mechanism 22 is a pliers with facing pliers grips 32 on each of the jaw pieces 24 and 28. Other types of jaw mechanisms such as a scissors, tongs, forceps, and the like could be used instead. A jaw pivot 34 including a jaw pivot pin 35 joins the first jaw piece 24 and the second jaw piece 28 so that the first jaw piece 24 and the second jaw piece 28 may pivot with respect to each other in a pivot plane 36, which in the illustrations of FIGS. 1 and 2 is the plane of the page.

A first lug attachment spacing 38 of the first lug attachment 26 from the jaw pivot pin 35 is greater than a second lug attachment spacing 40 of the second lug attachment 30 from the jaw pivot pin 35.

A first handle 42 is pivotably attached to the first lug attachment 26 by a first handle pivot 44 whose axis lies perpendicular to the pivot plane 36. The first handle 42 is thus pivotable about the jaw mechanism 22 in the pivot plane 36 between a fully folded position (illustrated in FIG. 2) wherein the first handle 42 lies adjacent to the jaw mechanism 22, and an unfolded position (illustrated in FIG. 1).

The first handle 42 preferably comprises an attachment clip 46. The attachment clip 46 includes a first gate attachment 48 and a spaced-apart second gate attachment 50, both of which are affixed to the first handle 42. A gate 52 has a first end 54 pivotably affixed to the first gate attachment 48. The gate 52 may be of any operable type. A preferred gate 52 comprises a folded length of heavy gauge wire, with one end inserted into a first through hole 53 in the first gate attachment 48 and the other end inserted into an adjacent second through hole 53' in the first gate attachment (from the opposite side so as not to be visible in FIG. 1). The bending of the wire and the insertion of the ends into the holes 53 and 53' produces a restoring force that tends to bias the gate 52 toward the closed position illustrated in FIG. 1. The gate 52 may instead be a solid piece of metal pivotably joined to the first gate attachment 48 and biased toward the closed position of FIG. 1 with a leaf spring.

The gate 52 faces away from the jaw mechanism 22 when the first handle 42 is in the fully folded position as illustrated in FIG. 2. The gate 52 may be forced open by manual pressure, so that a bulky object to which the combination tool 20 is to be attached may be forced between the gate attachments 48 and 50 and captured within the space defined by the gate attachments 48 and 50, the body of the handle 42, and the gate 52 after it is again closed. Such bulky objects include, for example, a ring attachment of the handle of a purse or brief case, a D-ring or ring, a rope, and the like. Conventional spring attachments of the type found on writing pens and knife belt clips cannot readily be used to attach the combination tool to such bulky objects. The first handle 42 may have other features instead of or in addition to the attachment clip 46, but inclusion of the attachment clip 46 is particularly preferred.

Figure 5:
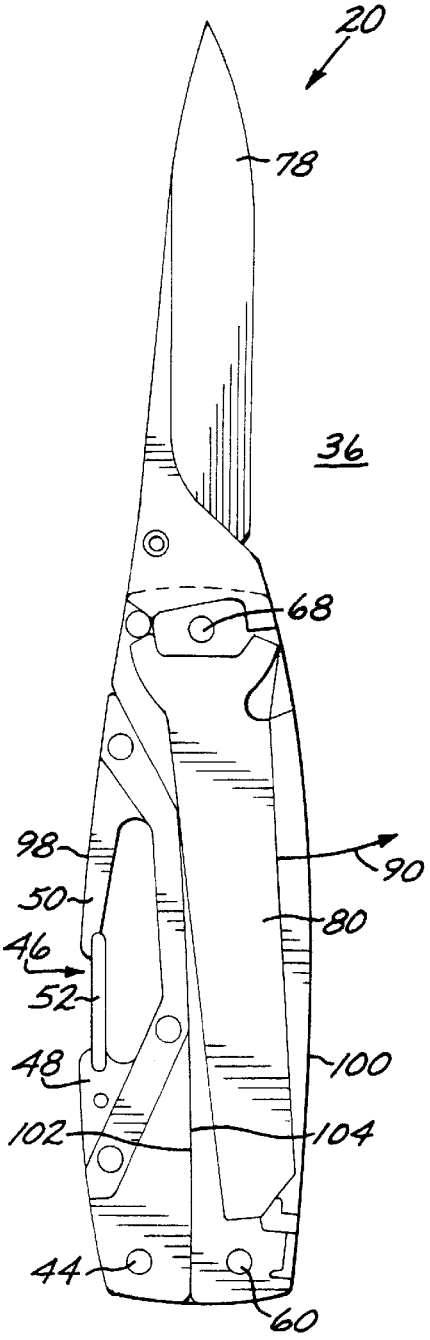
FIG. 5 is a schematic plan view of the combination tool of FIG. 2, showing the positioning of the long implements.
Figure 6:
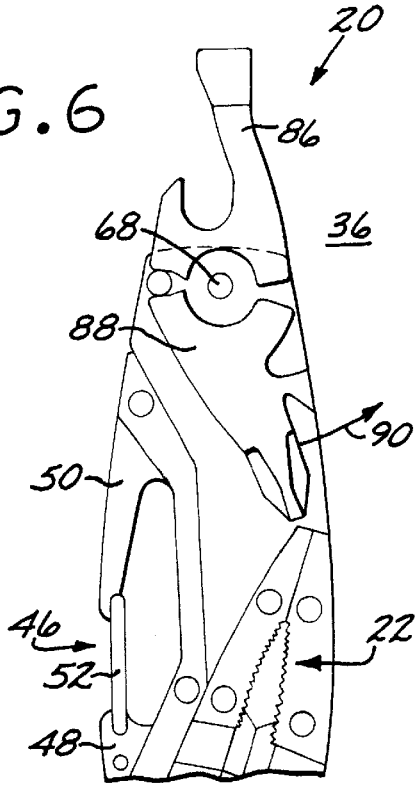
FIG. 6 is a schematic plan view of the combination tool of FIG. 2, showing the positioning of the short implements and the jaw mechanism.

A second handle 58 is pivotably attached to the second lug attachment 30 by a second handle pivot 60 lying perpendicular to the pivot plane 36. The second handle is pivotable about the jaw mechanism 22 in the pivot plane 36 between a fully folded position wherein the second handle 58 lies adjacent to the first handle 42 (illustrated in FIG. 2) and an unfolded position (illustrated in FIG. 1). The second handle 58 is preferably longer than the first handle 42 and is ergonomically curved so as to serve as a comfortable handle for the use of implements, as shown in FIGS. 5–6.

Figure 3:
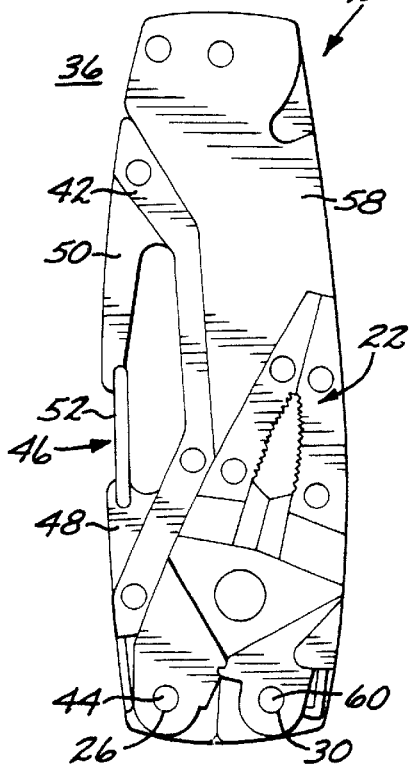
FIG. 3 is a schematic plan view of the combination tool of FIG. 2, showing the location of the jaw mechanism with the handles folded.

The asymmetric relation of the lug attachments 26 and 30, with their different respective lug attachment spacings 38 and 40, has several important consequences, one of which is illustrated in FIG. 3. When the handles 42 and 58 are rotated from their unfolded positions (FIG. 1) to their folded positions (FIG. 3), the second handle 58 rotates more than does the first handle 42. In a computer-simulated prototype, the first handle 42 rotates 154 degrees, while the second handle 58 rotates 186 degrees. The result is that the jaw mechanism 22 is asymmetrically positioned with respect to the two handles 42 and 58. The jaw mechanism 22 lies partially overlapped by and within the second handle 58, but the jaw mechanism 22 does not overlie the attachment clip 46 portion of the first handle 42. Thus, when the handles 42 and 58 are rotated to their folded positions as in FIG. 3, the attachment clip 46 is fully accessible and may be used to clip the combination tool 20 to objects, especially bulky objects. Absent the asymmetrical folding, the jaw mechanism 22 would partially or completely block the access to and use of the attachment clip 46, rendering it partially or completely inoperable.

Figure 4:
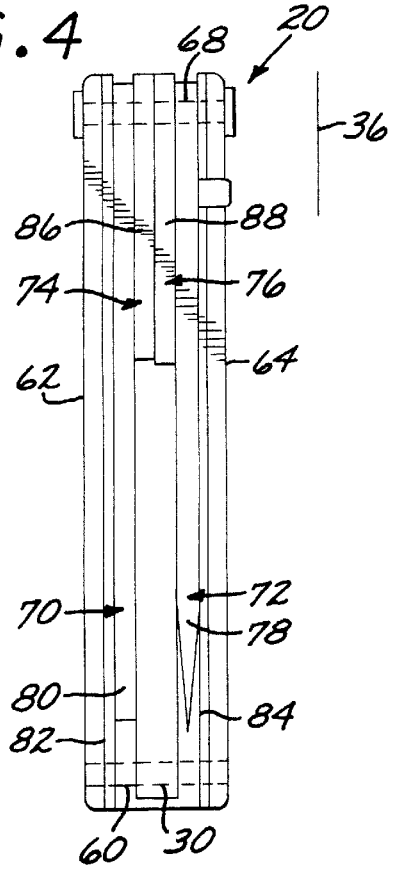
FIG. 4 is a bottom view of the combination tool of FIGS. 2 and 3 showing the structure of the second handle.

As seen in FIG. 4, the second handle 58 comprises a first side 62 and a second side 64 parallel to but spaced apart from the first side 62. The first side 62 and the second side 64 are each desirably generally planar in a plane parallel to the pivot plane 36. The first side 62 and the second side 64 are joined together in a facing relationship with a fixed spacing between the two sides 62 and 64 by a post structure. The post structure includes as many posts as may be required, but includes, for example, the pivot 60 and the pivot pin 68. Other non-pivot posts may be positioned as desired. In this preferred approach, there is no web connecting the sides 62 and 64 to define a generally U-shaped channel as is the case for many other combination tools.

The jaw mechanism 22 lies at least in part between the first side 62 and the second side 64 of the second handle 58 when the first handle 42 and the second handle 58 are in their fully folded positions.

A second-handle pivot pin 68 extends between the first side 62 and the second side 64 at a location remote from the second handle pivot 60. At least one implement, here illustrated as four implements 70, 72, 74, and 76, are pivotably supported on the second-handle pivot pin 68 through pivot bores in each of the implements. Each implement 70, 72, 74, and 76 is pivotable in a plane parallel to the pivot plane 36 between a closed position wherein the implement lies between the first side 62 and the second side 64, and an open position wherein the implement is extended from the second handle 58.

The implements 70, 72, 74, and 76 may be divided into two groups. The long implements 70 and 72 in part lie beside the jaw mechanism 22 when the handles 42 and 58 are in their folded positions (FIG. 4). Preferably, the short implements 74 and 76 do not lie beside the jaw mechanism 22 when the handles 42 and 58 are in their folded positions, although there may be some minor overlap.

FIG. 5 illustrates the long implements 70 and 72 in greater detail. The long implements 70 and 72, which in the illustration include a knife 78 and a flat file 80, lie on either side of the folded jaw mechanism 22. They may be biased toward open and closed positions by a conventional detent mechanism. They may also be releasably locked into their open positions. Any operable type of lock may be used, but the lock is preferably a side lock mechanism. In a side lock mechanism, described for example in U.S. Pat. Nos. 4,896,424 and 5,755,035, a side lock plate 82 and/or 84 lies between the sides 62 and 64 and adjacent to the respective long implements 70 and 72. A locking finger (not shown) extends laterally from the side lock plate to contact the base of the respective implement when the implement is in the open position to lock it in the open position. The implement may be unlocked by manual pressure against the locking finger to move it out of contact with the blade base, and simultaneously rotating the implement away from the locked-open position.

FIG. 6 illustrates the short implements 74 and 76 in greater detail. The short implements 74 and 76, which in the illustration include a flat screwdriver/bottle opener 86 and a Phillips head screwdriver 88, lie between the long implements 70 and 72. They may be biased toward open and closed positions by a conventional detent mechanism. The side lock locking mechanism cannot ordinarily be used, but the short implements 74 and 76 can be locked with a spring finger lock if desired.

As compared with a conventional symmetrical mechanism, the asymmetric folding of the handles 52 and 58 relative to the jaw mechanism 22 produces a larger useful volume and useful linear dimensions inside the second handle 58 for occupancy by the short implements 74 and 76, as illustrated in FIG. 6 for the flat screwdriver/bottle opener 86 and the Phillips head screwdriver 88. The jaw mechanism 22 is folded out of the way of these short implements.

An important feature of the present approach is that each implement 70, 72, 74, and 76 is pivotable between its closed position and its open position when the first handle 42 and the second handle 58 are in their fully folded positions as illustrated in FIGS. 5–6. This feature is achieved by pivoting each implement 70, 72, 74, and 76 away from the first handle 42 when the first handle 42 and the second handle are in their fully folded positions, to move from the closed position to the open position, as indicated by arrow 90.

This feature is a consequence of the described post-spacing structure for the handle 58, which allows pivoting access to the space between the sides 62 and 64 from both edges of the handle. That is, the jaw mechanism 22 may pivot into the space between the sides 62 and 64 from one edge (i.e., folding in from the left in FIG. 6), and the implements may pivot into the space between the sides 62 and 64 from the opposite edge (i.e., folding in from the right in FIG. 6). As a result, the implements may be opened and closed easily when the handles are in the fully folded position as illustrated in FIGS. 5–6.

As seen in FIG. 5, the first handle 42 and the second handle 58 are sculpted on their respective outward edges 98 and 100 that are grasped by the user's hand when the handles are folded closed and the combination tool 20 is being used as a knife. That is, these outward edges 98 and 100 are contoured in the manner of a knife handle, so that the combination tool 20 is highly ergonomic and comfortable to use when it is employed as a knife. The respective inward edges 102 and 104 of the handles 42 and 58 are cooperatively shaped so that they fit together when the handles 42 and 58 are folded together, as may be seen by comparing FIG. 5 and FIG. 1.

Figure 7:
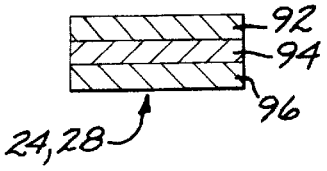
FIG. 7 is an enlarged sectional view through one of the jaw pieces of FIG. 1, taken on line 7—7.

Each of the jaw pieces 24 and 28 is preferably fabricated as a layered structure as shown in FIG. 7, although they could be cast instead. For example, the jaw pieces 24 and 28 may have three layers 92, 94, and 96. The layers 92, 94, and 96 may be made of different materials such as steels of different compositions. The layers 92, 94, and 96 may also be processed differently prior to being riveted or otherwise joined together. For example, the layers 92 and 96 may be quenched and tempered for toughness, and the layer 94 may be quenched only for high hardness and strength.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A folding combination tool comprising:

a jaw mechanism including a first jaw piece having a first lug attachment, a second jaw piece having a second lug attachment, and a jaw pivot that joins the first jaw piece and the second jaw piece so that the first jaw piece and the second jaw piece may pivot with respect to each other in a pivot plane, wherein a first lug attachment spacing of the first lug attachment from the jaw pivot is greater than a second lug attachment spacing of the second lug attachment from the jaw pivot;

a first handle pivotably attached to the first lug attachment by a first handle pivot lying perpendicular to the pivot plane, so that the first handle is pivotable about the jaw mechanism in the pivot plane; and a second handle pivotably attached to the second lug attachment by a second handle pivot lying perpendicular to the pivot plane, so that the second handle is pivotable about the jaw mechanism in the pivot plane, wherein the two handles are of different lengths.

2. The folding combination tool of claim 1, wherein the first handle comprises an attachment clip.

3. The folding combination tool of claim 1, wherein the second handle comprises a first side, a second side, and a post structure holding the first side and the second side in a parallel but spaced apart relationship, there being no web extending between the first side and the second side.

4. The folding combination tool of claim 1, wherein the second handle comprises a first side, a second side parallel to but spaced apart from the first side, a second-handle pivot pin extending between the first side and the second side at a location remote from the first lug attachment, and at least one implement pivotably supported on the second-handle pivot pin.

5. The folding combination tool of claim 1, wherein the second handle comprises a first side, a second side parallel to but spaced apart from the first side, a second-handle pivot pin extending between the first side and the second side at a location remote from the first lug attachment, at least one implement pivotably supported on the second-handle pivot pin, and a lock that releasably locks at least one of the implements into an open position.

6. The folding combination tool of claim 1, wherein the second handle comprises a planar first side lying in a first-side plane, a planar second side parallel to but spaced apart from the first side, and at least one implement pivotably supported on the first side and the second side to rotate in an implement plane parallel to the first-side plane.

7. The folding combination tool of claim 1, wherein the jaw mechanism comprises a pliers.

8. A folding combination tool comprising:

a jaw mechanism including a first jaw piece having a first lug attachment, a second jaw piece having a second lug attachment, a jaw pivot that joins the first jaw piece and the second jaw piece so that the first jaw piece and the second jaw piece may pivot with respect to each other in a pivot plane, wherein a first lug attachment spacing of the first lug attachment from the jaw pivot is greater than a second lug attachment spacing of the second lug attachment from the jaw pivot;

a first handle pivotably attached to the first lug attachment by a first handle pivot lying perpendicular to the pivot plane, so that the first handle is pivotable about the jaw mechanism in the pivot plane between a fully folded position wherein the first handle lies adjacent to the jaw mechanism and an unfolded position; and a second handle pivotably attached to the second lug attachment by a second handle pivot lying perpendicular to the pivot plane, so that the second handle is pivotable about the jaw mechanism in the pivot plane between a fully folded position wherein the second handle lies adjacent to the first handle and an unfolded position, wherein the second handle comprises a first side, a second side parallel to but spaced apart from the first side, there being no web connecting the first side and the second side, a second-handle pivot pin extending between the first side and the second side at a location remote from the first lug attachment, and at least one implement pivotably supported on the second-handle pivot pin, each implement being pivotable in the pivot plane between a closed position wherein the implement lies between the first side and the second side and an open position wherein the implement is extended from the second handle.

9. The folding combination tool of claim 8, wherein the second handle further comprises a side lock plate lying adjacent to one of the implements.

10. The folding combination tool of claim 8, wherein the jaw mechanism comprises a pliers.

11. The folding combination tool of claim 8, wherein each implement is pivotable between its closed position and its open position when the first handle and the second handle are in their fully folded positions.

12. The folding combination tool of claim 8, wherein each implement pivots away from the first handle to move from its closed position to its open position when the first handle and the second handle are in their fully folded positions.

13. The folding combination tool of claim 8, wherein the first handle comprises an attachment clip having a gate facing away from the jaw mechanism when the first handle is in the fully folded position.

14. A folding combination tool comprising:

a jaw mechanism including a first jaw piece having a first lug attachment, a second jaw piece having a second lug attachment, and a jaw pivot that joins the first jaw piece and the second jaw piece so that the first jaw piece and the second jaw piece may pivot with respect to each other in a pivot plane;

a first handle pivotably attached to the first lug attachment by a first handle pivot lying perpendicular to the pivot plane, so that the first handle is pivotable about the jaw mechanism in the pivot plane between a fully folded position wherein the first handle lies adjacent to the jaw mechanism and an unfolded position; and a second handle pivotably attached to the second lug attachment by a second handle pivot lying perpendicular to the pivot plane, so that the second handle is pivotable about the jaw mechanism in the pivot plane between a fully folded position wherein the second handle lies adjacent to the first handle and an unfolded position, the second handle comprising a first side and a second side parallel to but spaced apart from the first side, and wherein the jaw mechanism is asymmetrically positioned with respect to the first handle and the second handle when the first handle and the second handle are in their fully folded positions, and wherein the jaw mechanism lies at least in part between the first side and the second side of the second handle when the first handle and the second handle are in their fully folded positions.

15. The folding combination tool of claim 14, wherein the second handle further comprises a second-handle pivot pin extending between the first side and the second side at a location remote from the first lug attachment, and at least one implement pivotably supported on the second-handle pivot pin, each implement being pivotable in the pivot plane between a closed position wherein the implement lies between the first side and the second side and an open position wherein the implement is extended from the second handle.

16. The folding combination tool of claim 15, wherein the second handle further comprises a lock that releasably locks at least one of the implements into the open position.

17. The folding combination tool of claim 15, wherein each implement is pivotable between its closed position and its open position when the first handle and the second handle are in their fully folded positions.

18. The folding combination tool of claim 15, wherein each implement pivots away from the first handle to move from its closed position to its open position when the first handle and the second handle are in their fully folded positions.

19. The folding combination tool of claim 14, wherein the first handle comprises an attachment clip having a gate facing away from the jaw mechanism when the first handle is in the fully folded position.

20. The folding combination tool of claim 14, wherein the jaw mechanism comprises a pliers.

21. The combination tool of claim 8, wherein the two handles are of different lengths.

22. The combination tool of claim 14, wherein the two handles are of different lengths.

23. A folding combination tool comprising:

a jaw mechanism including a first jaw piece having a first lug attachment, a second jaw piece having a second lug attachment, and a jaw pivot that joins the first jaw piece and the second jaw piece so that the first jaw piece and the second jaw piece may pivot with respect to each other in a pivot plane, wherein a first lug attachment spacing of the first lug attachment from the jaw pivot is greater than a second lug attachment spacing of the second lug attachment from the jaw pivot;

a first handle pivotably attached to the first lug attachment by a first handle pivot lying perpendicular to the pivot plane, so that the first handle is pivotable about the jaw mechanism in the pivot plane; and a second handle pivotably attached to the second lug attachment by a second handle pivot lying perpendicular to the pivot plane, so that the second handle is pivotable about the jaw mechanism in the pivot plane, wherein the second handle comprises a first side, a second side, and a post structure holding the first side and the second side in a parallel but spaced apart relationship, there being no web extending between the first side and the second side.

* * * * *